US008033208B2

(12) United States Patent
Joynt et al.

(10) Patent No.: US 8,033,208 B2
(45) Date of Patent: Oct. 11, 2011

(54) MINE RESISTANT ARMORED VEHICLE

(75) Inventors: Vernon P. Joynt, Pretoria (ZA); John W. North, Ladson, SC (US); Jonathan W. Georgas, Summerville, SC (US); James E. White, Charleston, SC (US); Michael L. Williams, North Charleston, SC (US); Thomas E. Borders, III, Summerville, SC (US)

(73) Assignee: Force Protection Technologies, Inc., Ladson, SC (US)

( * ) Notice: Subject to any disclaimer, the term of this patent is extended or adjusted under 35 U.S.C. 154(b) by 0 days.

(21) Appl. No.: 12/662,183

(22) Filed: Apr. 5, 2010

(65) Prior Publication Data

US 2010/0275766 A1 Nov. 4, 2010

Related U.S. Application Data

(60) Provisional application No. 61/202,844, filed on Apr. 10, 2009.

(51) Int. Cl.
*F41H 7/02* (2006.01)

(52) U.S. Cl. ..... 89/36.08; 89/36.07; 89/36.09; 296/193.07; 296/187.07; 296/187.08

(58) Field of Classification Search ..... 89/36.01–36.12; 296/187.07, 193.07
See application file for complete search history.

(56) References Cited

U.S. PATENT DOCUMENTS

D142,247 S 8/1945 Hill
2,382,862 A * 8/1945 Davis, Jr. ..... 296/187.07
(Continued)

FOREIGN PATENT DOCUMENTS

DE 196 31 715 A1 2/1998
(Continued)

OTHER PUBLICATIONS

PCT Search Report for PCT/US 10/30418 dated Apr. 8, 2010 (13 pages).

(Continued)

*Primary Examiner* — Michael Carone
*Assistant Examiner* — Samir Abdosh
(74) *Attorney, Agent, or Firm* — Finnegan, Henderson, Farabow, Garrett & Dunner, LLP

(57) ABSTRACT

In one aspect, the present disclosure is directed to a blast-resistant armored land vehicle. Wheels or tracks may be attached to the vehicle by an independent suspension. The vehicle may include a body comprised of sheet materials, the body having a longitudinal centerline, an upper portion including opposite side portions, a first bottom portion defining a V, with the apex of the V substantially parallel to the longitudinal centerline of the vehicle and extending along a portion of the vehicle, and a second bottom portion defining a V, with the apex of the V substantially parallel to the longitudinal centerline of the vehicle and extending along another portion of the vehicle. The first bottom portion further includes an energy-absorbing member extending longitudinally within an interior of the first bottom portion. The energy-absorbing member may be on the inside of the apex of the V and be held in position during the blast by its own inertia. The vehicle may also include a spine member having a V shaped cross section and extending along the entire length of the vehicle. All or a portion of the engine, transmission, and drive train assembly may be within the spine member. A vehicle not having a second bottom portion may be retrofitted with the second bottom portion by way of a kit.

20 Claims, 5 Drawing Sheets

U.S. PATENT DOCUMENTS

| | | | | |
|---|---|---|---|---|
| D143,365 | S | 12/1945 | Sutphen | |
| D144,344 | S | 4/1946 | Alexander | |
| D164,216 | S | 8/1951 | Baldine | |
| 3,176,585 | A | 4/1965 | Ruf | |
| 3,720,280 | A | 3/1973 | Eiler | |
| 4,156,536 | A | 5/1979 | Brandstadter | |
| 4,158,986 | A | 6/1979 | Appelblatt et al. | |
| 4,174,653 | A | 11/1979 | Appelblatt | |
| 4,280,393 | A | 7/1981 | Giraud et al. | |
| 4,319,777 | A | 3/1982 | Law | |
| 4,326,445 | A | 4/1982 | Bemiss | |
| 4,492,282 | A | 1/1985 | Appelblatt et al. | |
| 5,370,034 | A | 12/1994 | Turner et al. | |
| 6,173,482 | B1 | 1/2001 | Riddle et al. | |
| 6,254,394 | B1 | 7/2001 | Draper et al. | |
| 6,435,071 | B1 | 8/2002 | Campbell | |
| 6,477,934 | B1 | 11/2002 | Bruhn et al. | |
| 7,357,062 | B2 * | 4/2008 | Joynt | 89/36.08 |
| 7,357,065 | B2 | 4/2008 | Mitsui | |
| 7,685,924 | B2 | 3/2010 | Barbe et al. | |
| 7,712,823 | B2 | 5/2010 | Greuter et al. | |
| 2003/0010189 | A1 | 1/2003 | Zonak | |
| 2005/0257679 | A1 * | 11/2005 | Hass et al. | 89/36.09 |
| 2007/0113730 | A1 | 5/2007 | Benyami et al. | |
| 2007/0180981 | A1 | 8/2007 | Tapp et al. | |
| 2007/0234896 | A1 * | 10/2007 | Joynt | 89/36.09 |
| 2008/0034953 | A1 | 2/2008 | Barbe et al. | |
| 2008/0111396 | A1 | 5/2008 | Barbe et al. | |
| 2009/0114083 | A1 | 5/2009 | Moore, III et al. | |
| 2009/0140545 | A1 | 6/2009 | Greuter et al. | |
| 2009/0293712 | A1 * | 12/2009 | Ran et al. | 89/36.08 |
| 2010/0187864 | A1 * | 7/2010 | Tsuchida | 296/193.07 |
| 2010/0218667 | A1 * | 9/2010 | Naroditsky et al. | 89/36.02 |
| 2010/0307327 | A1 | 12/2010 | Gettle | |
| 2010/0307329 | A1 | 12/2010 | Kaswen et al. | |
| 2010/0319525 | A1 | 12/2010 | Pavon | |

FOREIGN PATENT DOCUMENTS

| | | | |
|---|---|---|---|
| DE | 196 31 715 | C2 | 1/2000 |
| EP | 1 821 061 | A1 | 8/2007 |
| EP | 1821061 | A1 | 8/2007 |
| EP | 2 128 558 | A2 | 12/2009 |
| EP | 2128558 | A2 | 12/2009 |
| TW | 438694 | B | 6/2001 |
| TW | 468136 | B | 12/2001 |
| WO | WO 02/39048 | A2 | 5/2002 |
| WO | WO 2009/140331 | A2 | 11/2009 |

OTHER PUBLICATIONS

UK Search Report for GB1008141.2 dated Jun. 10, 2010 (6 pages).

UK Search Report mailed Dec. 14, 2010, for Application No. GB1019014.8.

UK Search Report mailed Dec. 14, 2010, for Application No. GB1019015.5.

* cited by examiner

MINE RESISTANT ARMORED VEHICLE

CROSS REFERENCE TO RELATED APPLICATION

This application claims the benefit of U.S. Provisional Application No. 61/202,844, filed Apr. 10, 2009, which is herein incorporated by reference in its entirety.

FIELD OF THE INVENTION

The present invention relates to an armored motor vehicle, specifically one that has improved resistance to land mines and improvised explosive devices deployed on the path of the motor vehicle.

BACKGROUND OF THE INVENTION

Conventional armored motor vehicles attempt to moderate the effect of mines and explosive devices by using armor of a thickness that will not be penetrated by penatrators, soil, rocks or the like, or by the blast from such a mine or explosive device. Such vehicles generally have bottom surfaces parallel to the surface on which they ride and side surfaces perpendicular to the surface on which they ride. In addition, conventional vehicles may mount auxiliary items on the side of the vehicle.

When such vehicles detonate an anti-vehicle mine below the vehicle, a penetrator and/or debris above the mine is propelled upward. If the bottom of the vehicle is flat and parallel to the ground, much of the energy of the mine and any material propelled by it may hit the bottom surface perpendicular to its surface. As a result, the energy of the material and the blast is most efficiently transferred to that surface and the probability that the armor bottom will be defeated and breached is maximized. Additionally, the energy of the material and the blast being transferred to that surface may cause the vehicle itself to be propelled upward, and in some cases, leave the surface on which the vehicle runs. Furthermore, side mounting the auxiliary items may prevent the blast energy from the explosive device dissipating away from the vehicle and instead may transfer the blast energy back into the vehicle.

Traditional theory says that the blast energy of a mine, specifically a shaped mine, is directed upwards from the mine in conical shape. However, when a traditional mine is buried beneath the ground, such as, for example, under sand or soil, the blast results in a cylindrical column of sand. This column typically has less than a 5 degree deviation in any direction. This column of sand or soil can be referred to as the "soil ejecta." Because the traditional theory relies on the concept of a conical shaped upward blast, then conventional mine protected vehicles have been designed with a relatively higher ground clearance to allow more of the blast energy to dissipate in the space above the ground before encountering the bottom of the vehicle. However, because very little energy dissipates from the soil ejecta before it contacts the vehicle, the higher ground clearance has little if any effect. Therefore, a high ground clearance may only serve to raise the center of gravity of the vehicle. This, in combination with the auxiliary items may cause the vehicle to have a higher center of gravity and may reduce the maneuverability of the vehicle.

If the bottom of the vehicle is not flat, e.g. has a V shape, energy and blast material impulses may be less efficiently transferred to the body of the vehicle. One such example of this is U.S. Pat. No. 7,357,062 to Joynt ("the '062 patent"). The '062 patent discloses a mine resistant armored vehicle with a V-shaped bottom portion of the body, and with the angle of the V between about 115 and 130 degrees. While this V-shaped bottom portion may help reduce the transfer of blast energy to the body of the vehicle, further improvements may be made considering ejecta columns that launch almost straight upwards.

SUMMARY OF THE INVENTION

In one aspect, the present disclosure is directed to a mine blast-resistant armored land vehicle. The vehicle may include a body comprised of sheet materials, the body having a longitudinal centerline, an upper portion including opposite side portions, a first bottom portion, and a second bottom portion. Wherein the first bottom portion defines a V, with the apex of the V substantially parallel to the longitudinal centerline of the vehicle, an energy-absorbing member extending longitudinally within the first bottom portion. Further, the second bottom portion defines a second V, with the apex of the second V substantially parallel to the longitudinal centerline of the vehicle, the second bottom portion being detachably secured to the vehicle exterior to and spaced from the first bottom.

In another aspect, the present disclosure is directed to a mine blast-resistant armored land vehicle. The vehicle comprising a body comprised of sheet materials, the body having a longitudinal centerline and a bottom portion, and an upper portion including opposite side portions, the bottom portion defining at least one V, with the apex of the V substantially parallel to the longitudinal centerline of the vehicle. The vehicle further includes a metal spine extending longitudinally along and within an interior of the apex of the V, an engine detachably affixed to the metal spine, a transmission connected to the engine, and a drive train assembly connected to the engine, the drive train assembly being detachably affixed to the metal spine. Further, the bottom portion further includes a metal energy-absorbing member extending longitudinally along and within an interior of the metal spine.

Additional advantages of the invention will be set forth in part in the description which follows, and in part will be obvious from the description, or may be learned by practice of the invention. One or more of the advantages the invention may be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION OF THE DRAWINGS

Reference will now be made in detail to the present embodiments of the invention, examples of which are illustrated in the accompanying drawings. Wherever possible, the same reference numbers will be used throughout the drawings to refer to the same or like parts.

In accordance with the invention, there is provided a blast-resistant armored land vehicle that may include a monocoque body comprised of sheet material. In the context of the present invention the phrase "blast-resistant" means that the vehicle is particularly resistant to penetration by either the blast energy or material propelled by the blast energy from a land mine that explodes beneath the vehicle. In the context of the present invention the phrase "land vehicle" means a vehicle intended primarily to propel itself on the surface of the ground. In the context of the present invention the word "monocoque" means a shell of sheet material joined with either welds, adhesives, fasteners, or combinations thereof to form a vehicle body that is structurally robust enough to eliminate the need for a separate load-bearing vehicle frame on which a body, engine, and drive train would normally be attached. In the context of the present invention, the word "adhesive" means material that strengthens after its initial application to join two solid pieces. Such a material can be a conventional adhesive (a liquid that solidifies or cross-links to bond materials in contact therewith).

Figure 1:
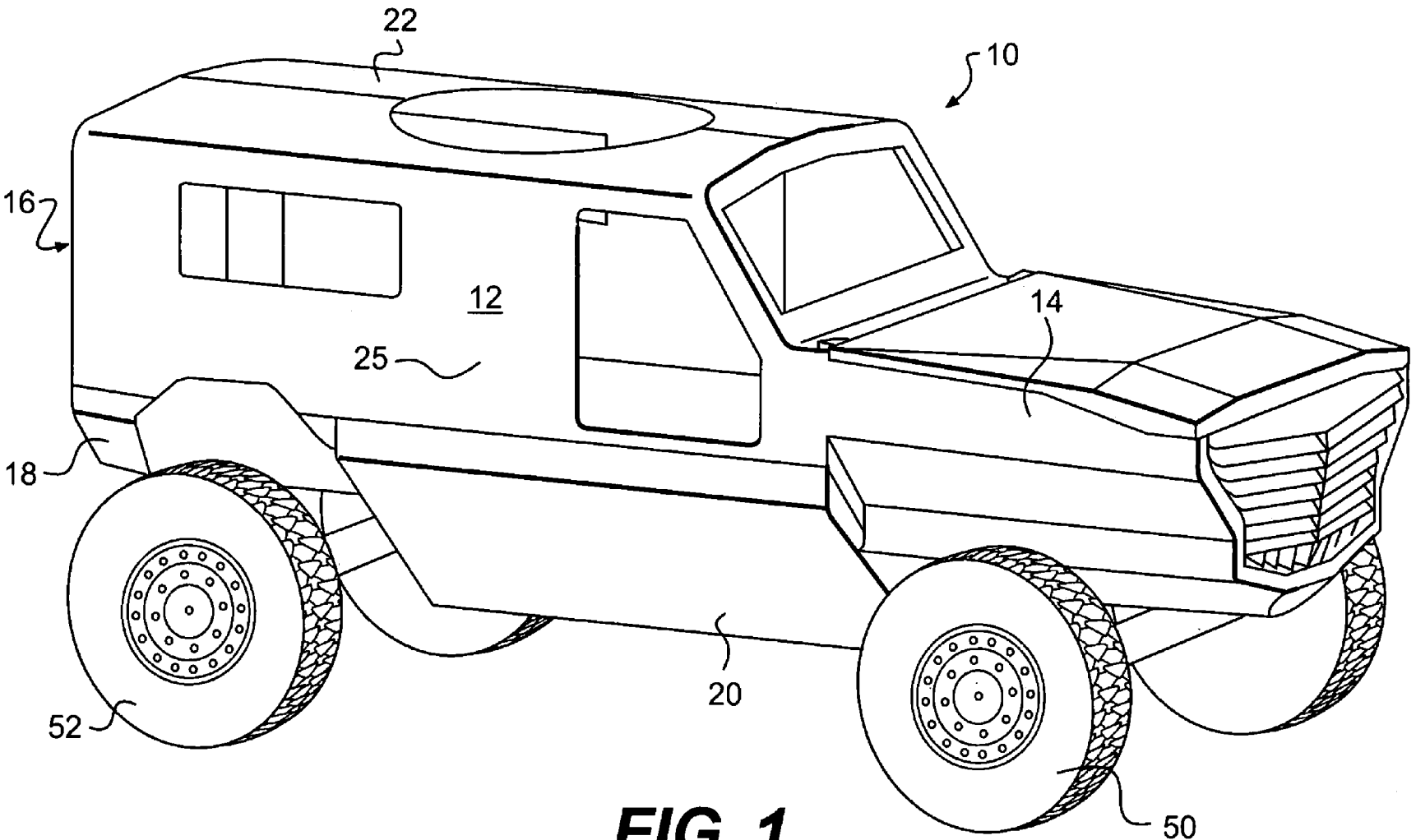
FIG. 1 is a perspective view of one embodiment of the present invention.

As here embodied, and depicted in FIG. 1, a vehicle 10 may include a body 12 formed of sheet materials with a front end 14, a rear end 16, a first bottom portion 18, a second bottom portion 20, a top portion 22, a left side portion 25, a right side portion 25' (shown in FIG. 2), and a centerline (not shown) along the front-to-rear axis of the vehicle 10 approximately half way between the right and left sides of the vehicle.

As broadly embodied in FIG. 1, vehicle 10 may further include a set of front wheels 50 and rear wheels 52. While the embodiment depicted is a 4×4 (4 wheels total×4 wheels driven), the present invention is not limited thereto. The invention can be used in a 6×6 configuration, or any number or combination of driven and/or non-driven wheels. The invention may also be used for vehicles driven by tracks, or a combination of wheels and tracks.

Body 12 of vehicle 10 may include a "double wedge," i.e. a bottom with two V portions. The double wedge may include the first bottom portion 18 and the second bottom portion 20. Second bottom portion 20 may serve to interrupt the trajectory of the soil ejecta as well as any blast energy. When the soil ejecta contacts second bottom portion 20, the speed of the debris may be slowed and deflected and any debris that penetrates second bottom portion 20 may cause little if any harm to first bottom portion 18. Additionally, a mine blast may cause second bottom portion 20 to deform. While the deformation of second bottom portion 20 may be sufficient to cause second bottom portion 20 to contact first bottom portion 18, the contact may cause little or no harm to first bottom portion 18. The thickness and weight of second bottom portion 20 must be sufficient to slow the soil ejecta and blast energy, and the thickness and weight of first bottom portion 18 must be sufficient to withstand contact with the slowed soil ejecta and any deformation of second bottom portion 20. In this manner, the combined weight of first bottom portion 18 and second bottom portion 20 may be less than the weight of the bottom portion of a conventional anti-mine vehicle.

Figure 2:
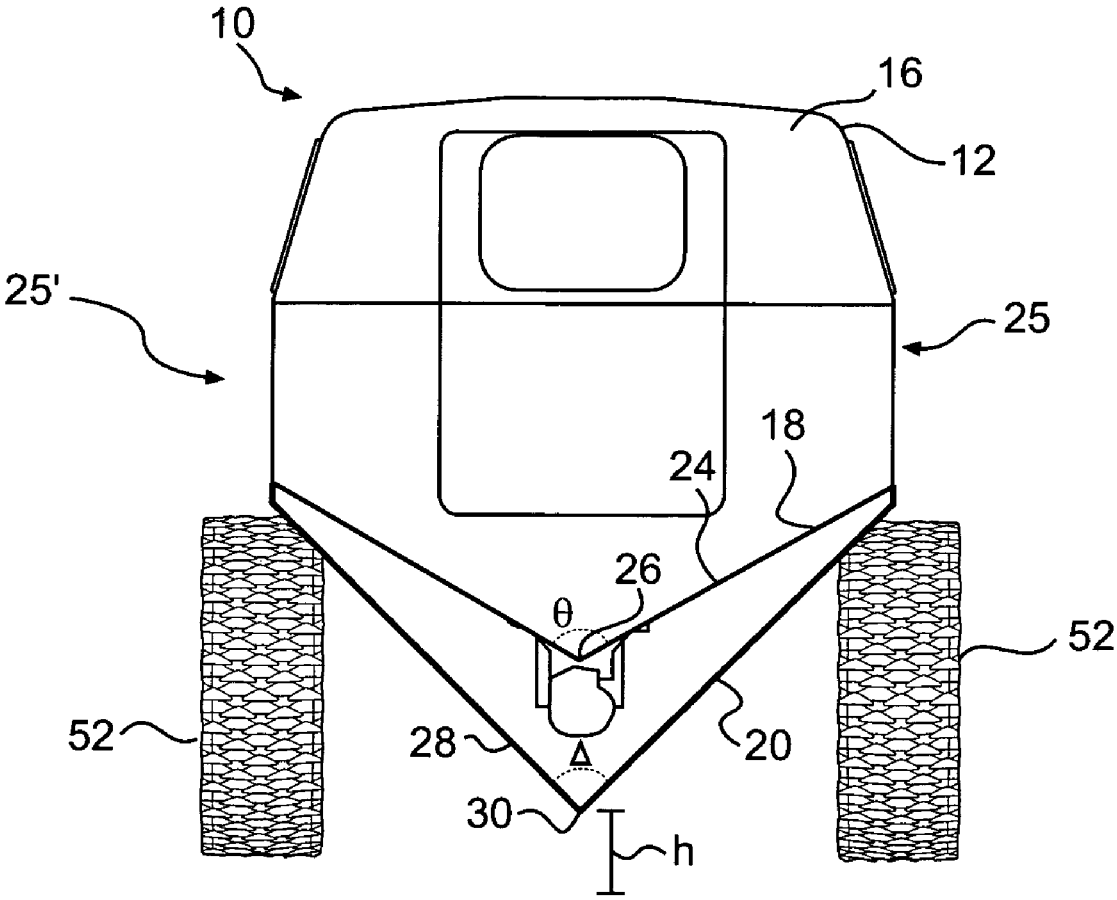
FIG. 2 is a schematic rear view depicting one preferred configuration of the vehicle shown in FIG. 1.

In the embodiment depicted in FIG. 2, first bottom portion 18 comprises the V-shaped portion 24 with the apex of the V directed downward. V 24 is shown here as having a single angle, however, it is contemplated that V 24 may include a single angle or a compound angle. V 24 may extend the length of the vehicle 10, and has an apex 26 (the narrowest, pointed end of the V) extending substantially parallel to the centerline. Preferably the angle of the V 24 (shown as Θ in FIG. 2) may be within a range of from 115° to 130°, and most preferably 120°. Apex 26 may preferably have a radius in the range of from 1 to 4 inches. When the tip radius is less than 1 inch apex 26 may crack during the bending to form the V. When the tip radius is greater than 4 inches blast energy and associated material directed upward from beneath the vehicle will more efficiently transfer to the first bottom portion 18 of the vehicle.

In the embodiment depicted, and with continued reference to FIG. 2, second bottom portion 20 comprises a V-shaped portion 28, with the apex of the V directed downward. V 28 may extend the length of a portion of the vehicle 10, specifically the wheelbase, having an apex 30 extending substantially parallel to the centerline. It is contemplated that second bottom 20 may extend along a larger portion of vehicle 10, including the length of vehicle 10. Preferably the angle of the V 28 (shown as Δ in FIG. 2) may be less than or equal to 90° and most preferably less than or equal to 70°. When the angle Δ is significantly greater than 90° blast energy directed upward from beneath the vehicle will more efficiently transfer to the bottom portion of the vehicle. While it is depicted as having a single angle, it is contemplated that V 28 of second bottom portion 20 may be a single angle or a compound angle. Apex 30 may preferably have a radius in the range of from 1 to 6 inches When the tip radius is less than 1 inch the apex V 30 may crack during the bending to form the V. When the tip radius is greater than 6 inches blast energy and associated material directed upward from beneath the vehicle will more efficiently transfer to the second bottom portion 20 of vehicle 10.

In accordance with the invention, apex 30 may be located any distance above the surface of the land on which the vehicle operates. As here embodied, and with continued reference to FIG. 2, the vehicle 10 has a ground clearance h (the distance above the surface of the land on which the vehicle operates) as measured from the lowest extremity (apex 30 of V 28) of the second bottom portion 20 of the vehicle 10. However, as discussed previously, because the dissipation of the soil ejecta is minimal, and because the angle of V 28 of second bottom portion 20 causes the blast energy and material to be directed around body 12 of vehicle 10, the ground clearance of vehicle 10 may have a less significant affect on the effect of the blast energy and material. Because the ground clearance of vehicle 10 may be reduced, the overall center of gravity of vehicle 10 may be reduced. By reducing the center of gravity of vehicle 10, the stability of vehicle may be increased and may have a reduced risk of rollover if the vehicle is turned at too sharp a radius and/or at too high a speed. In this manner, the determinative factor for the ground clearance of vehicle 10 is the operational parameters of vehicle 10, such as, for example, minimum ground clearance required to traverse the specific environment in which vehicle 10 operates.

Figure 3:
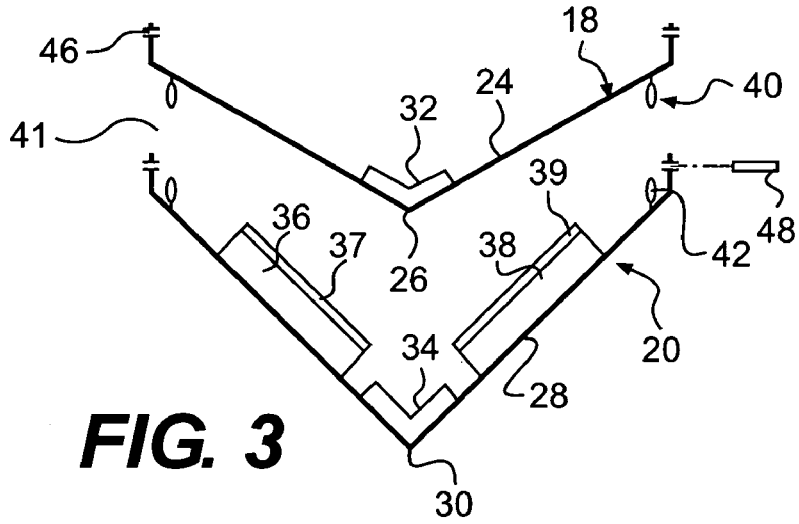
FIG. 3 is a schematic cross-sectional view of a bottom portion of the vehicle shown in FIG. 1.

FIG. 3 depicts first bottom portion 18 and second bottom portion 20 may include an energy-absorbing buffer to reduce the effectiveness of a blast occurring beneath vehicle 10. An energy-absorbing buffer may be thick relative to first bottom portion 18 and second bottom portion 20, and may include a metal pipe, a metal half-pipe, or most preferably a piece of metal formed to conform to the apex of the V. The energy-absorbing buffer should be formed in order to maximize surface area contact between the energy-absorbing buffer and the V. In this manner, when a blast occurs below vehicle 10 the energy caused by the blast forces the V of vehicle 10 into the energy absorbing buffer. The inertia effect of the blast contacting the V and then the V subsequently being directed into the energy-absorbing buffer, causes the effective weight of the energy-absorbing buffer to be significantly higher than the actual weight. Furthermore it is not necessary for the energy absorbing buffer to be positively fixed to the V, it is sufficient for the energy-absorbing buffer to lay, or nest, within the V. During the blast, the energy-absorbing buffer is held in place by its own inertia. It is contemplated that fuel may be stored in the interior of first bottom portion 18 and/or second bottom portion 20, in this manner, the fuel may act in a similar fashion as the energy-absorbing buffer.

As here embodied and depicted if FIG. 3, apex 26 may include a first energy-absorbing buffer 32 extended longitudinally inside apex 26 of V 24. The energy-absorbing buffer 32 may be fastened, preferably by welding, to the interior of V 24 and it is preferably comprised of a relatively heavy metal. Most preferably, the metal is steel because of its cost and the ease with which it can be joined to a steel body by welding. It is also contemplated that energy-absorbing buffer 32 may be nested within apex 26 of V 24. In this manner, energy-absorbing buffer 32 may be held in place by its weight. Similarly, V 28 of second bottom portion 20 may include a second energy absorbing buffer 34 that may be fastened to apex 30 or nested within apex 30.

Second bottom portion 20 may also include at least one auxiliary item. FIG. 3 depicts second bottom portion 20 including a first auxiliary item 36 and a second auxiliary item 38. An auxiliary item may be any item usable by vehicle 10 or the occupant of vehicle 10, such as, for example, main or auxiliary fuel tanks, tool storage, general storage, or any other type of auxiliary item known in the art. In this manner, auxiliary items that may otherwise be stored outside of body 12 may be stored within body 12 between first bottom portion 18 and second bottom portion 20. By relocating auxiliary items from outside of body 12 blast energy and material may better dissipate around vehicle 10. Furthermore, by storing auxiliary items between first bottom portion 18 and second bottom portion 20, the center of gravity of vehicle 10 may further be lowered. While FIG. 3 is depicted as showing two auxiliary items, it is contemplated that vehicle 10 may have any number of auxiliary items.

In accordance with the invention, the auxiliary items may be constructed to minimize their effect on vehicle 10 during a blast. This is particularly important when the auxiliary items comprise a fuel tank or fuel tanks. The auxiliary items may be constructed to direct the contents of the auxiliary items towards the sides of vehicle 10, instead of the contents being directed towards the occupants of vehicle 10. Specifically, as depicted in FIG. 3, a sheet 37 of auxiliary item 36, and a sheet 39 of auxiliary item 38, may comprise a different material than the rest of the auxiliary item. Reference will be made to sheet 37 of auxiliary item 36, however, it is contemplated that sheet 39 of auxiliary item 38 may have the same characteristics. While sheet 37 is depicted as being on the outside of auxiliary item 36, it is contemplated that sheet 37 may be secured within auxiliary item 36. Specifically sheet 37 may comprise a glass material, such as, for example plate glass. Glass is ideal because it is relatively inexpensive. When a blast occurs below vehicle 10, shock may be transferred from bottom portion 20 into the contents of auxiliary item 36, such as fuel that may be in a fuel tank. The shock from the blast may then be transferred into sheet 37, whether sheet 37 is located within auxiliary item 36 or outside of auxiliary item 36. The shock may travel along the length of sheet 37 and be projected upwardly and outwardly away from the auxiliary item and approximately towards a gap 41 (described below). It is believed that because glass transmits shock at high speed relative to liquid, sheet 37 may disintegrate into sand and exit vehicle 10 via gap 41. It is further believed that the high speed exit from the vehicle of the sand may create a vacuum and draw the contents of auxiliary item 36 out of the vehicle via gap 41. By way of example, glass may transmit shock energy at 5500-6000 meters per second (m/s). Liquids like water (approximately 1500 m/s) and fuels (approximately 1400 m/s) conduct the shock slower. Therefore, a sheet of glass at an angle to the shock direction, that is mounted in the fluid or outside of the fluid tank, will be able to deflect the shock direction to the direction the glass is pointing. It is contemplated that the construction of the auxiliary items is not limited to the theories set out above. While side 37 and 38 are described as comprising glass, it is contemplated that ceramic (approximately 7000-8000 m/s) could be used. The specific numbers used above are for exemplary purposes only and are not meant be limiting.

Figure 4A:
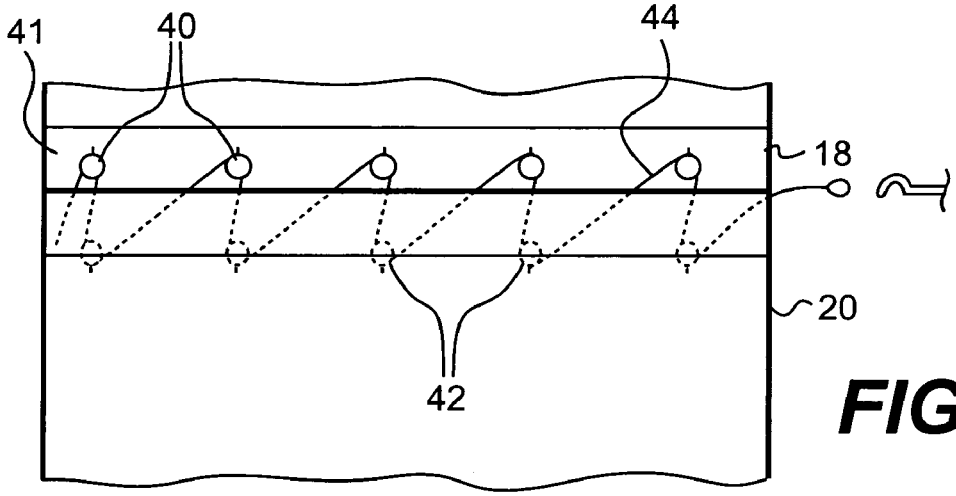
FIG. 4A is a side view of a portion of the bottom portion of the vehicle depicted in FIG. 1.
Figure 4B:
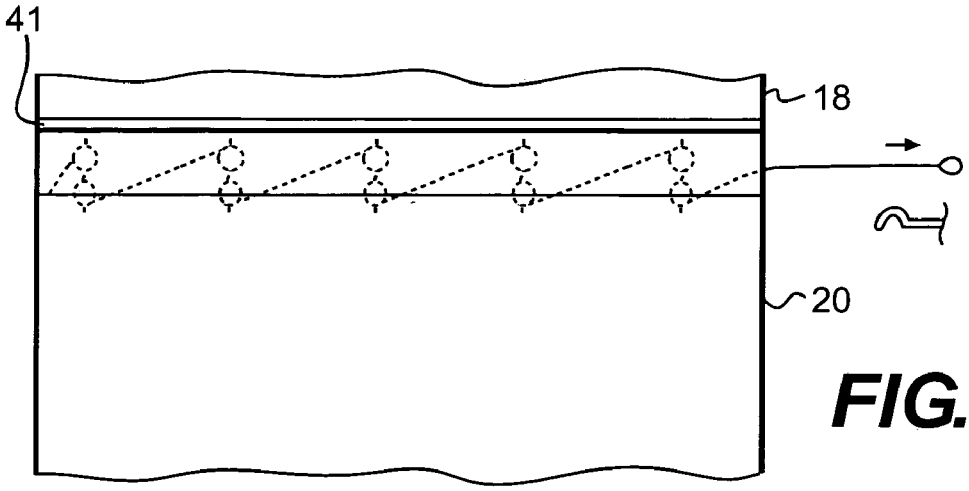
FIG. 4B is another side view of a portion of the bottom portion of the vehicle depicted in FIG. 1.

FIGS. 4A and 4B show an apparatus for detachably securing second bottom portion 20 to first bottom portion 18. As shown in FIG. 3, first bottom portion 18 may include a first plurality of pulleys 40 and second bottom portion 20 may include second plurality of pulleys 42. First plurality of pulleys 40 and second plurality of pulleys 42 may be positioned substantially opposite each other. First bottom portion 18 and second bottom portion 20 may also include at least one locking pin hole 46. At least one locking pin 48 may be disposed in at least one locking pin hole 46 of first bottom portion 18 and at least one locking pin hole 46 of second bottom portion 20. Second bottom portion 20 may be secured to first bottom portion 18 by the at least one locking pin 48

FIGS. 4A and 4B depict one way to secure second bottom portion 20 to first bottom portion 18 using first plurality of pulleys 40 and second plurality of pulleys 42. At least one rope 44 may be fixed on one end to either first bottom portion 18 or second bottom portion 20. The rope may preferably be a wire rope, but is not limited as such and may be any rope known in the art, such as for example, natural fiber, synthetic fiber, or any other rope known in the art. First plurality of pulleys 40 and second plurality of pulleys 42 may be configured to accept rope 44, and rope 44 may be fed alternatively between a pulley of the first plurality of pulleys 40 and a pulley of the second plurality of pulleys 42. A second end of rope 44 may be fixed to a winch (not shown). The winch may be fixed to and part of vehicle 10, alternatively the winch may be separate from vehicle 10. The winch may be rotated, and in this manner, second bottom portion 20 may be brought up to first bottom portion 18. By using this rope and pulley system, an occupant of vehicle 10 my easily raise and lower the second bottom portion 20, in order to access the auxiliary items stored between first bottom portion 18 and second bottom portion 20. Locking pin 48 may allow second bottom portion 20 to be secured to first bottom portion 18 without the use of a plurality of bolts. In this manner the occupant of vehicle 10 may easily fix and unfix the second bottom portion 20. While it is depicted with a single rope 44, it is contemplated that each side of vehicle 10 may include a rope 10.

FIG. 4B depicts second bottom portion 20 after it has been raised by way of rope 44, first plurality of pulleys 40, and second plurality of pulleys 42. It is contemplated that gap 41 may remain open to allow expulsion of the contents of auxiliary item 36 and auxiliary item 38 as described above. In all cases, second bottom portion 20 may be dimensioned with a flange (not shown) to secure second bottom portion 20 to first bottom portion 18 or to sides 25 and 25' with a bolt, plurality of bolts, locking pin, or plurality of locking pins.

As here embodied, and with reference to FIGS. 1-4, the vehicle 10 is a 4×4 wheeled vehicle with an engine, detachably connected to the vehicle 10 within the front end 14 of the body 12. The engine is preferably a diesel-cycle engine because of the normal advantages of diesel power for relatively heavy vehicles in addition to the fact that diesel fuel is relatively difficult to ignite by an explosive device penetrating the fuel tank. In a preferred embodiment, the engine may be a commercially available diesel engine, although a engine specially developed for the vehicle could be used. The use of a commercially available engine reduces the cost of the vehicle and simplifies the design and manufacturing process because the size and location of ancillary engine components (e.g., engine motor mounts, not shown) can be readily ascertained from the commercial application and engine installation publications available from the engine manufacturer. The engine cooling system, exhaust system and electrical system may be conventional. Additionally, any compatible transmission and suspension system may be used.

Additionally, it is contemplated that an existing vehicle may be retrofitted with a second bottom portion to gain the benefits of the double wedge as described throughout by using an assemblage of required parts specific to the vehicle, e.g. in kit form.

Figure 5:
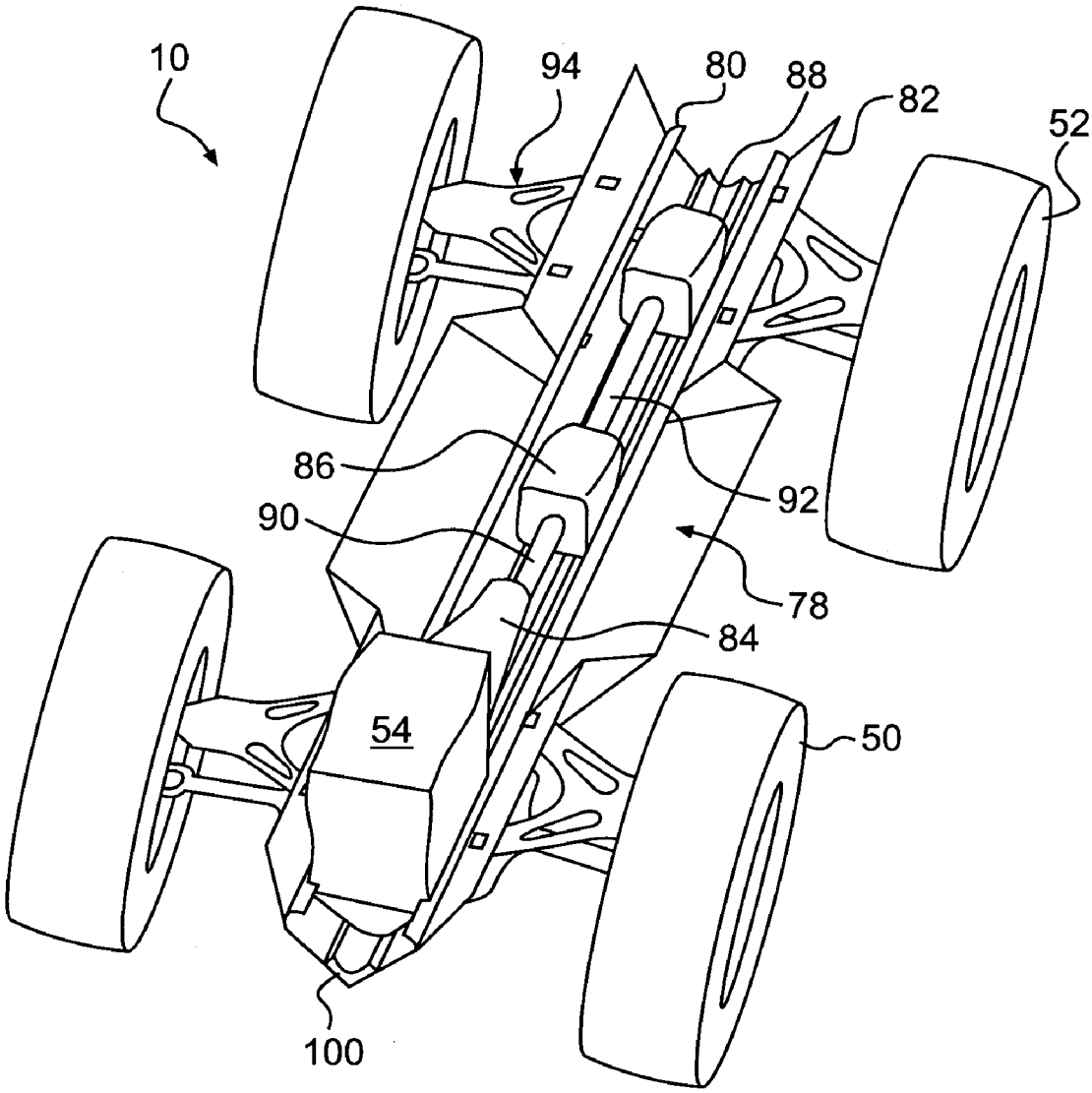
FIG. 5 is a perspective view of another embodiment of the present invention depicting a vehicle spine component.
Figure 6:
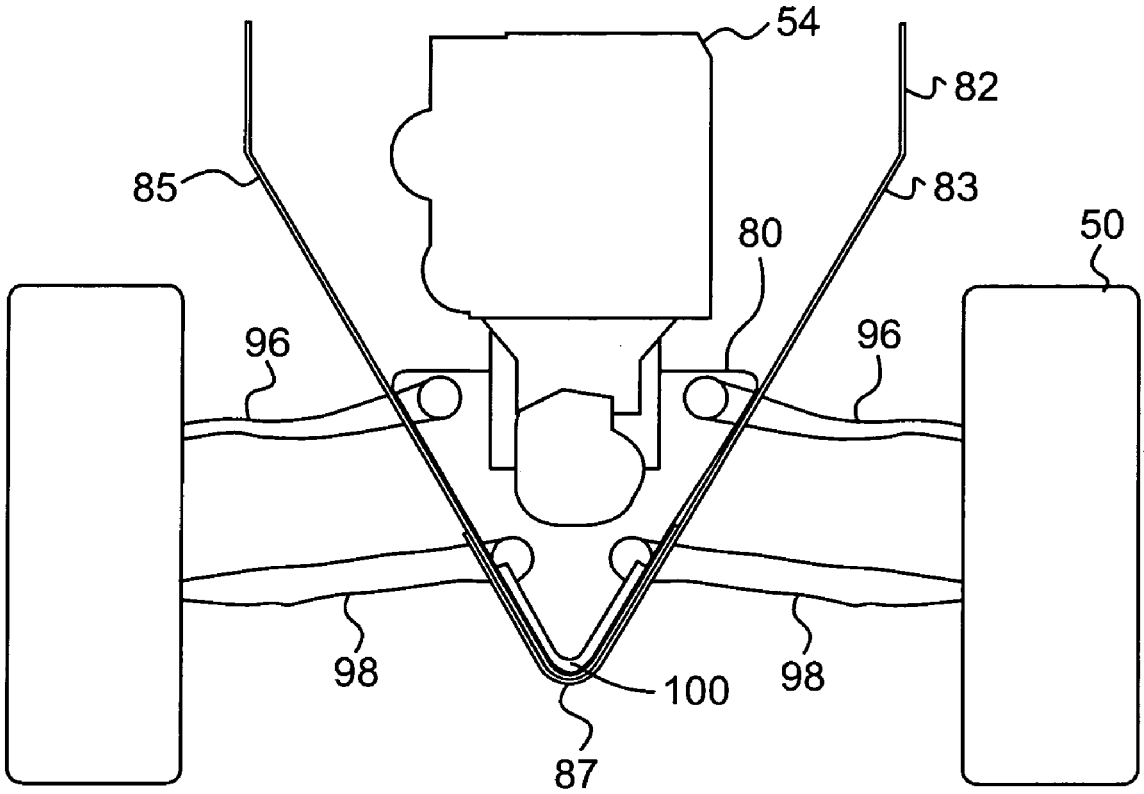
FIG. 6 is a front cross-sectional view of the vehicle of FIG. 6.

FIGS. 5 and 6 depict an alternative layout of a lower body portion of vehicle 10. FIGS. 5 and 6 only depict certain aspects of vehicle 10 in order to more clearly see those features. Vehicle 10 may include a body 78, front wheels 50, and rear wheels 52. Body 78 may include a energy-absorbing buffer 100, a spine 80, and a shell 82. Spine 80 may be generally V shaped and may extend the entire length of vehicle 10. It is contemplated that energy-absorbing buffer 100 may be thicker than spine 80, and that spine 80 may be thicker than shell 82. It is contemplated that energy absorbing buffer 100 may be similar to that described above. Shell 82 of body 78 may include first side 83 and second side 85. As depicted in FIG. 6, first side 83 may extend beyond an apex 87 of spine 80, and under second side 85. Similarly, second side 85 may extend beyond apex 87 of spine 80 and over first side 83. It is contemplated that first side 83 may extend over or under second side 85.

FIG. 5 depicts body 78 of vehicle 10 as comprising multiple angles. Specifically body 78 comprises a first angle in the front portion of vehicle 10, a second angle in the middle portion of vehicle 10, and a third angle in the rear portion of vehicle 10. It is contemplate that body 78 may be the same angle the entire length of vehicle 10, may have second angle different from the first and third angles as depicted in FIG. 5, may have the second and third angles the same and different from the first, or any other combination of body angles known in the art. As depicted in FIG. 5, a wider angle in the middle portion of vehicle 10 provides more space for the occupants of vehicle 10.

Vehicle 10 may include an engine 54 and independent suspension 94. Independent suspension 94 may include upper suspension arm 96 and lower suspension arm 98. Independent suspension 94 may allow vehicle 10 to maneuver better. Upper suspension arm 96 and lower suspension arm 98 may connect front wheels 50 and rear wheels 52 to spine 80 of vehicle 10. While FIG. 6. depicts vehicle 10 as having an independent suspension, it is contemplated that vehicle 10 may have a non-independent suspension in the front or rear, or combination of independent and non-independent suspension. FIG. 6 also depicts a portion of engine 54 within spine 80. By lowering engine 54 into spine 80, the center of gravity of vehicle 10 may be lower. The benefits of a lower center of gravity of vehicle 10 have been discussed previously.

Vehicle 10 may include a transmission 84 connected to a transfer case 86 by a first drive shaft 90. A portion of engine 54 and transmission 84 are preferably mounted within the spine 80 of body 78. Preferably transfer case 86 is as close to the for and aft center of the vehicle as possible. Preferably a portion of transfer case 86, front drive shaft 90 and a rear drive shaft 92, and a rear differential 88 are located at least partially within spine 80.

Front drive shaft 90 transmits power to the front differential (not shown) which may be mounted within spine 80 of the vehicle body 12. Similarly, rear drive shaft 92 transmits power to rear differential 88, which may be mounted on spine 80 of the body 12. As here embodied the drive train may be detachably mounted to the interior of spine 80. Because the drive components are detachably affixed to the interior of spine 80 of body 78, they may be protected from blast energy and materials and may be more likely to survive the blast. In this manner a vehicle 10 that has sustained damage may be able to continue to operate sufficiently.

It will be apparent to those skilled in the art that various modifications and variations can be made to the vehicle of the present invention without departing from the spirit or scope of the invention. By way of example, it is contemplated that vehicle depicted in FIGS. 5 and 6 may include a Second bottom portion fixed above the spine. Further it is contemplated that the vehicle depicted in FIGS. 1-4 may include a spine component. Thus, it is intended that the present invention cover all modifications and variations of this invention which fall within the scope of the following claims and their equivalents.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A blast-resistant armored land vehicle comprising:

a body comprised of sheet materials, the body having a longitudinal centerline, an upper portion including opposite side portions, a first bottom portion, and a second bottom portion;

the first bottom portion defining a first V, with an apex of the first V substantially parallel to the longitudinal centerline of the vehicle, an energy-absorbing member extending longitudinally within the first bottom portion; and the second bottom portion defining a second V, with an apex of the second V substantially parallel to the longitudinal centerline of the vehicle, the second bottom portion being detachably secured to the vehicle exterior and spaced from the first bottom portion, the apex of the first V of the first bottom portion being located above the apex of the second V of the second bottom portion;

wherein the first and second bottom portions form a bottom of the vehicle.

2. The vehicle of claim 1, further including a second energy-absorbing member extending longitudinally within the second bottom portion.

3. The vehicle of claim 1, wherein an angle of the apex of the first V of the first bottom portion is greater than an angle of the apex of the second V of the second bottom portion.

4. The vehicle of claim 3, wherein the angle of the first V of the first bottom portion is between 115 degrees and 130 degrees and the angle of the second V of the second bottom portion is less than or equal to 90 degrees.

5. The vehicle of claim 1, wherein at least one auxiliary item is affixed to the interior of the second bottom portion between the first bottom portion and the second bottom portion.

6. The vehicle of claim 5, wherein the at least one auxiliary item includes a glass portion and the glass portion is configured to direct contents of the at least one auxiliary item towards the opposite sides of the vehicle in response to a blast.

7. The vehicle of claim 1, wherein the second bottom portion includes a plurality of first pulleys, the first bottom portion includes a plurality of second pulleys, and a portion of the first pulleys are substantially opposed to a portion the second pulleys; and wherein the vehicle further includes at least one rope, the rope is secured to one of the first bottom portion or the second bottom portion, and the rope is alternatively located between the plurality of first pulleys and the plurality of second pulleys.

8. The vehicle of claim 1, further including a metal spine extending longitudinally along and within an interior of the apex of the second V of the second bottom portion.

9. A kit for retrofitting a blast resistant vehicle, the vehicle having a first bottom portion defining a V, with an apex of the V substantially parallel to the longitudinal centerline of the vehicle, the kit including:

a member configured as a second bottom portion defining at least one V for positioning exterior to and spaced from the first bottom portion, wherein an angle of the V of the second bottom portion is less than an angle of the V of the first bottom portion; and an apparatus configured to detachably secure the member to the vehicle with the apex of the at least one V of the second bottom portion being directed downward;

wherein the first and second bottom portions form a bottom of the vehicle.

10. The kit of claim 9, further including a metal energy-absorbing member extending longitudinally along within an interior of the second bottom portion.

11. The kit of claim 9, wherein the member is configured to define a storage space interior to the member and exterior to the first bottom portion when affixed.

12. The vehicle of claim 1, wherein the longitudinal centerline is between the opposite side portions.

13. The vehicle of claim 1, wherein the apex of the first V of the first bottom portion and the apex of the second V of the second bottom portion are directed downward.

14. The vehicle of claim 1, wherein the apex of the second V of the second bottom portion is below a center of a wheel of the vehicle.

15. The vehicle of claim 1, wherein the first and second bottom portions extend along at least a majority of a width and a length of the vehicle.

16. The vehicle of claim 5, wherein the at least one auxiliary item includes a fuel tank.

17. The kit of claim 9, wherein the apparatus is further configured to adjust a size of a gap formed between the first bottom portion and the second bottom portion, the gap being open towards an outside of the vehicle when the member is secured to the first bottom portion.

18. The kit of claim 9, wherein the apex of the at least one V of the second bottom portion is located below the apex of the V of the first bottom portion.

19. A blast-resistant armored land vehicle comprising:

a body comprised of sheet materials, the body having a longitudinal centerline, an upper portion including opposite side portions, a first bottom portion, and a second bottom portion;

the first bottom portion defining a first V, with an apex of the first V substantially parallel to the longitudinal centerline of the vehicle, an energy-absorbing member extending longitudinally within the first bottom portion;

the second bottom portion defining a second V, with an apex of the second V substantially parallel to the longitudinal centerline of the vehicle, the second bottom portion being detachably secured to the vehicle exterior and spaced from the first bottom portion such that a gap is formed between the first bottom portion and the second bottom portion, the gap being open towards an outside of the vehicle when the second bottom portion is secured to the first bottom portion;

wherein the first and second bottom portions form a bottom of the vehicle.

20. The vehicle of claim 19, further comprising an apparatus configured to detachably secure the second bottom portion to the vehicle exterior, the apparatus being configured to adjust a size of the gap by moving the second bottom portion with respect to the first bottom portion.

* * * * *